US005911201A

United States Patent [19]

Eickenberg

[11] Patent Number: 5,911,201

[45] **Date of Patent: *Jun. 15, 1999**

[54] STEAM BOILER WITH PRESSURIZED CIRCULATING FLUIDIZED BED FIRING

[75] Inventor: Leonhard Eickenberg, Brüggen, Germany

[73] Assignee: LLB Lurgi Lentjes Babcock Energietechnik GmbH, Dusseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,710

[22] Filed: Jan. 10, 1997

Related U.S. Application Data

[63] Continuation of application No. 08/781,710, Jan. 10, 1997.

[30] Foreign Application Priority Data

Jan. 13, 1996 [DE] Germany ..... 196 01 031

[51] Int. Cl.[6] ..... F22B 1/00; B09B 3/00

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 5,069,170 | 12/1991 | Gorzegno et al. | 110/245 |
| 5,095,854 | 3/1992 | Dietz | 110/245 |
| 5,133,943 | 7/1992 | Abdually | 110/245 |
| 5,159,886 | 11/1992 | Schaub et al. | 110/245 |
| 5,176,109 | 1/1993 | Engstrom | 122/4 D |
| 5,181,481 | 1/1993 | Dietz | 110/245 |
| 5,215,042 | 6/1993 | Beisswenger et al. | 110/245 |
| 5,293,843 | 3/1994 | Provol et al. | 122/4 D |
| 5,324,421 | 6/1994 | Rahlwes | 122/4 D |
| 5,341,766 | 8/1994 | Hyppanen | 110/245 |
| 5,345,883 | 9/1994 | Panos | 122/4 D |
| 5,443,806 | 8/1995 | Isaksson et al. | 122/4 D |
| 5,463,968 | 11/1995 | Abdulally | 122/4 D |
| 5,499,498 | 3/1996 | Isaksson | 60/39.12 |
| 5,537,941 | 7/1996 | Goidich | 122/4 D |

*Primary Examiner*—Teresa Walberg
*Assistant Examiner*—Jiping Lu
*Attorney, Agent, or Firm*—Max Fogiel

[57] ABSTRACT

A continuously operated boiler heated with a pressurized circulating fluidized bed firing consists of a fluidized bed burner chamber (1) and one or more cyclones (5) connected in series after the fluidized bed burner chamber (1) and on the flue gas side. A fluidized bed cooler (12) is connected in series after each cyclone (5) which cooler is connected by way of a dip pot (8) with the solids output of the cyclone on one hand and with the fluidized bed burner chamber 91) on the other hand. A return conduit (10) is connected with the dip pot (8) which opens into the fluidized bed burner chamber 91). Pressure vessels (18, 19) house the fluidized bed burner chamber (1), the cyclone (5) and the fluidized bed cooler 912). The fluidized bed cooler (12), the cyclone (5) and the dip pot (8) are thereby combined into a unite which is housed in the common pressure vessel (19).

11 Claims, 1 Drawing Sheet

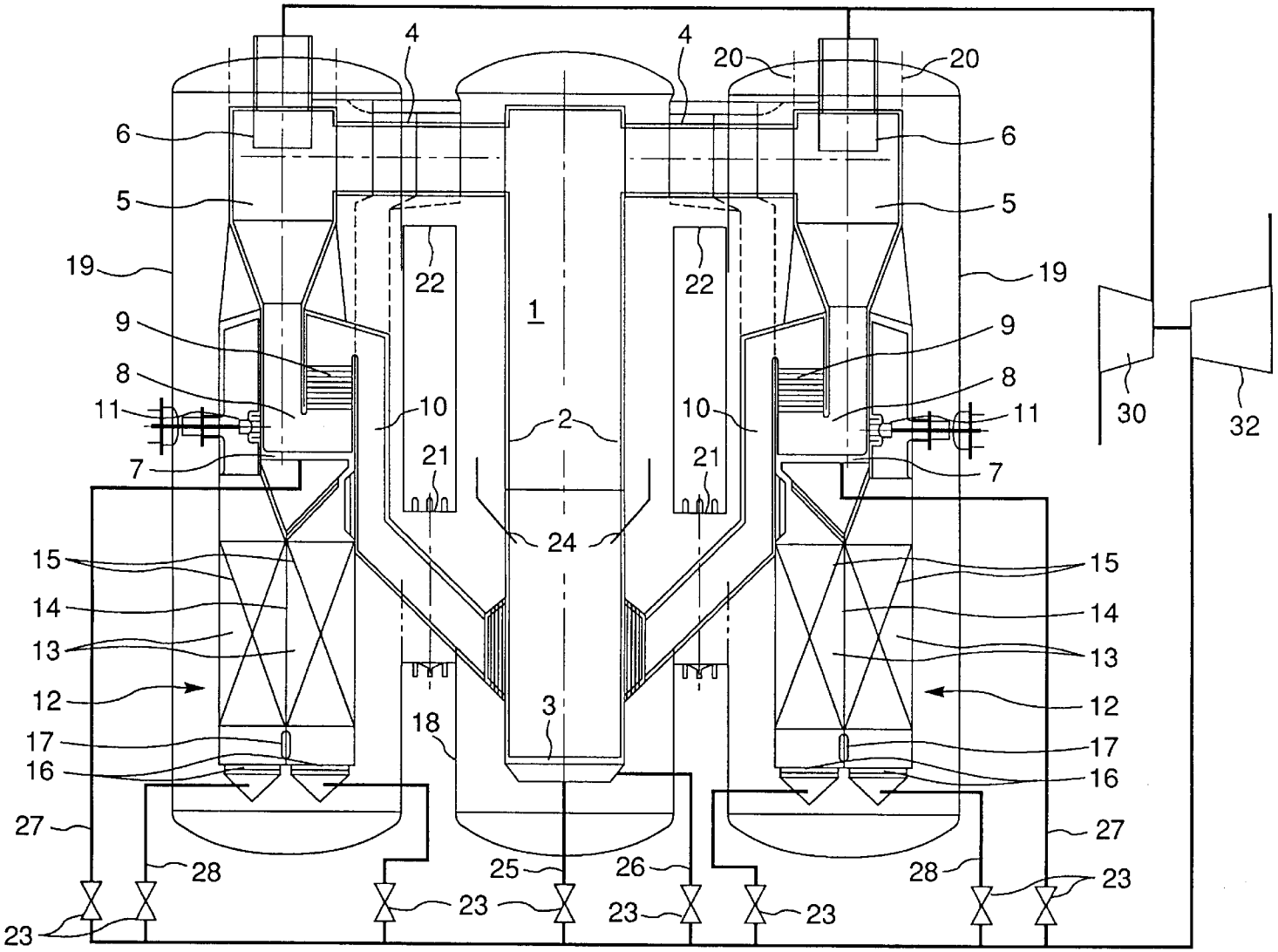
32
30
19
20
6
5
9
8
11
7
15
14
13
12
17
16
27
23
28
4
22
10
21
1
2
24
3
26
25
18

STEAM BOILER WITH PRESSURIZED CIRCULATING FLUIDIZED BED FIRING

This application is a continuation of application Ser. No. 08/781,710, filed Jan. 10, 1997, now abandoned.

BACKGROUND TO THE INVENTION

The invention relates to a boiler with a pressurized circulating fluidized bed firing.

This boiler is part of a combined gas-steam power plant, whereby the flue gases produced in the fluidized bed fire box are transported to the gas turbine after a hot gas cleaning and at the temperature of the fluidized bed of 800 to 1000° C. In this combined process, the advantageous combustion and emission properties of a circulating fluidized bed firing, which operates at high pressure, and the special heat uptake distribution from the cooling of the flue gas and solids in the boiler can be combined with the gas turbine operation for optimal energy use.

SUMMARY OF THE INVENTION

It is an object of the invention to advantageously coordinate the individual reaction and heat exchanger components of the boiler.

The invention provides an arrangement with relatively small space and material requirements. Furthermore, the characteristics of the low pollution combustion reaction, including the unavoidable tolerances are considered independent of each other from a process point of view and independent of the individually different characteristics of the solid transport and the heat exchange with the also unavoidable tolerances, and this results in an especially flexible arrangement which is stable over large load ranges and can be operated for any steam parameter. A further advantage is the favourable exploitability of extreme steam parameters by way of highly alloyed materials in the range of moderate intake temperatures in connection with extremely small amounts of material. The current limits achievable with boilers of known construction and with flexible fuels, which limits result from the load capacity of the surrounding pipe walls and their material specifications thereby no longer exist.

BRIEF DESCRIPTION OF THE DRAWING

An exemplary embodiment of the invention is shown in the drawing and will be further described in the following. The drawing schematically illustrates a boiler.

DESCRIPTION OF THE PREFERRED EMBODIMENTS

Of a combined gas-steam power plant, only the boiler is shown. The boiler is heated by way of a circulating fluidized bed firing and includes a fluidized bed burner chamber 1. The fluidized bed burner chamber 1 is defined by the walls 2 of gas tight welded together tubes. The cross section of the fluidized bed burner chamber 1 is downwardly conically tapered in the lower part at two opposing walls which are not shown in the drawing. The tube walls 2 of the fluidized bed chamber 1 are ceramically coated especially in the lower highly solids-enriched part in order to prevent wear of the tubes. However, the upper part of the fluidized bed burner chamber 1 which is less loaded with solids can also be provided with a ceramic coating which has advantageous heat transfer characteristics to protect it against wear by the solids. No heat exchange surfaces are provided within the fluidized bed burner chamber 1. The fluidized bed burner chamber 1 is downwardly closed by a nozzle floor 3. One or more connecting conduits 4 which respectively lead to a cyclone 5 are connected to the fluidized bed burner chamber 1. In the cyclone 5, the suspended solids are separated from the flue gas and the solids free flue gas is guided to a hot gas filter though dip conduit 6 of the cyclone 5 and without cooling is guided to the not illustrated gas turbine installation.

The solid's output of the cyclone 5 opens into a dip pot 8 provided with a nozzle floor 7, which pot principally operates as a syphon and as a solids return flow check valve prevents a short circuit on the flue gags side between the fluidized bed burner chamber 1 and the cyclone 5. The open side of the dip pot a is provided with an overflow gate and connected to a return conduit 10. The return conduit 10 opens into the fluidized bed burner chamber 1.

The dip pot 8 is provided with an opening for the removal of a portion from the main solids return flow which opening is closable by a control member 11. The control member 11 can be an externally operable lancet-shaped valve provided with ceramic or metallic wear and heat protection. However, an overflow with gate can be used which is pneumatically operated with combustion air and the overflow edge of which can be horizontal or slanted. The control of the pneumatic air flow can be continuous, intermittent or pulsed. The height of the overflow edge can be fixed or variably adjustable relative to the height of the overflow of the dip pot 8.

The secondary solids flow which is divided out from the dip pot 8 by way of the control element 11 is guided to fluidized bed cooler 12 which is positioned below the dip pot 8. The flowing bed cooler 12 includes several chambers 13 which are separated by a separation wall 14. Each chamber 13 of the fluidized bed coolers 12 houses one heat exchanger bundle 15. A nozzle floor is provided below each chamber 13 through which air is blown for fluidizing the solids contents of the chamber 13. The nozzle floors of the chambers 13 can be supplied with fluidizing air from the same or separate sources. In the illustrated case, two chambers 13 are positioned side by side. Especially at higher throughput, the chambers 13 can also be positioned one above the other. The flow of the solids through the chambers 13 can be upward or downward. The chambers 13 of the illustrated fluidized bed coolers 12 are connected with each other below the heat exchanger bundles 15 through an opening 17 in the separation wall 14. In this way, a downward flow is induced in the first chamber 13 exposed to the solids and an upward flow in the chamber 13 subsequently exposed to the same solids. It is also possible to guide a partial solids stream downward and to directly guide a make up solids stream to the subsequent chambers 13 by appropriately selecting the height of a gate in the separation wall 14 between the chambers 13.

The output end of the last exposed chamber is connected to the return conduit 10. In this way, the solids as well as the fluidizing air are guided from the fluidized bed cooler 12 and a dip pot 8 through the return conduit 10 and into the fluidized bed burner chamber 1. The solids transported from the fluidized bed burner chamber 1 into the cyclone 5 are used as heat carrier from which heat is extracted in the fluidizing bed cooler 12 with the help of the fluidizing air which is a portion of the combustion air. The solids thereby develop a high heat transition capacity whereby large amounts of heat can be transferred with the smallest heat transfer surfaces. The so cooled solids flow is after the heat transfer fully or partly mixed with the uncooled solids return flow and returned to the fluidized bed burner chamber 1. The cyclone 5, the dip pot 8, the fluidized bed cooler 12, the connecting conduit 4 and the return flow conduit 10 are defined by the walls of gas tight welded together tubes, just as the fluidized bed burner chamber 1. The tube walls are made of planar pipe panels and form a polygon whereby the lowest number of corners is 4. The tube walls are protected against unacceptable deformation by appropriate external reinforcing bands.

To compensate the high gas counter pressure of the gas turbine, the individual components of the boiler are housed in separate, cylindrical pressure vessels with preferably vertical axes. A first pressure vessel 18 encloses the fluidized bed burner chamber 1. A further pressure vessel 19 houses respectively a cyclone 5 with the dip pot 8 positioned therebelow and the fluidized bed cooler 12. The cyclone 5, the dip pot 8 and the fluidized bed cooler 12 are combined into a unit which is suspended in the respective pressure vessel 19 by way of anchors 20.

The cylindrical pressure vessels 18, 19 are connected by cylindrical ducts 21, 22 with horizontal or inclined axes. Positioned within these ducts 21, 22 are the pipe-shaped connecting conduits 4 and return conduits 10 for the fluid and solids transport from the fluidized bed burner chamber 1 to the other components and vice versa. These pipe shaped conduits 4, 10 at the same time provide the connection between the pipe systems positioned in the individual pressure vessels 18, 19

The intermediate space between the pressure vessels 18, 19 and the components positioned therein and surrounded by the gas tight tube walls is kept at a slight over pressure relative to the gas operating pressure in the interior of the components. This over pressure is produced by blowing blocking air from the gas turbine compressor 30 of the associated gas turbine 32 installation into the intermediate space by way of an air conduit 25 with a control valve 23. The blocking air at the same time serves as secondary air for the fluidized bed firing. Secondary air nozzles 24 are provided for this purpose which are guided through the pipe wall 2 of the upper part of the fluidized bed burner chamber 1, are open to the intermediate space and are respectively provided with a return flow check valve arrangement, which is not illustrated. The over pressure is adjusted by way of the secondary air nozzles 24 and preferably self-regulating because of the dynamic resistance of the fluidized bed burner chamber 1. In special circumstances, the over pressure can be adjusted with the help of a regulating arrangement. The remaining air flows, such as the primary and fluidizing air for the fluidized bed burner chamber 1 and the fluidizing air for the dip pots 8 and the fluidized bed coolers 12 are necessarily guided to the individual nozzle floors 3, 7, 16 by way of separate air conduits 26, 27, 28 respectively.

The pipes of the individual pipe walls are on the water/steam side connected in series and to a common water steam circuit. This water-steam-circuit is operated with continuous flow according to the Benson principle. The connection in series in the water-steam-circuit is carried out in such a way that the flow preferably passes first through the pipe walls of one fluidized bed coolers 12 and the associated cyclone 5 witch dip pot 8 and subsequently without intermediate collector through the connecting conduit 4 and the return conduit 10 which is positioned in the same pressure vessel 19. In this way, the water-steam-mixture carrying pipe system is guided without additional connecting conduits into the fluidized bed burner chamber 1. The second fluidized bed cooler-cyclone-group is connected in reverse series to the pipe system of the fluidized bed burner chamber with multiple upwards and downward flows. Thereafter follow the heat exchanger bundles 15 of the fluidized bed cooler 12, which are operated as further evaporators and as superheaters. The economizer is positioned in the exhaust heat vessel placed in series after the gas turbine.

I claim:

1. A steam generator with pressurized, circulating fluidized bed firing, comprising: a fluidized bed burner chamber; at least one cyclone connected to a flue gas side of said fluidized bed burner chamber through a connecting conduit; said cyclone having a solids output; a fluidized bed cooler connected behind said cyclone; a dip pot connected to said solids output of said cyclone and to said fluidized bed cooler; a return flow conduit connected to said dip pot and entering into said fluidized bed burner chamber; a plurality of pressure vessels, one of said pressure vessels housing said fluidized bed burner chamber, said fluidized bed cooler, said dip pot, and said cyclone being connected to a unit, said unit being housed in another of said pressure vessels; a gas turbine system with a compressor connected to an intermediate space between respective units and the respective pressure vessel, said intermediate space being subjected to air over pressure from said gas turbine system; ducts connecting said pressure vessels; said connecting conduit being positioned between said fluidized bed burner chamber and said cyclone as well as said return flow conduit from said dip pot and said fluidized bed cooler and leading to said fluidized bed burner chamber through said ducts.

2. A steam generator as defined in claim 1, wherein said connecting conduit and said return flow conduit comprise pipe walls forming a connection between said one pressure vessel and said other pressure vessel.

3. A steam generator with pressurized, circulating fluidized bed firing, comprising: a fluidized bed burner chamber; at least one cyclone connected to a flue gas side of said fluidized bed burner chamber through a connecting conduit; said cyclone having a solids output; a fluidized bed cooler connected behind said cyclone; a dip pot connected to said solids output of said cyclone and to said fluidized bed cooler; a return flow conduit connected to said dip pot and entering into said fluidized bed burner chamber; a plurality of pressure vessel, one of said pressure vessels housing said fluidized bed burner chamber, said fluidized bed cooler, said dip pot, and said cyclone being connected to a unit, said unit being housed in another of said pressure vessels; said unit being suspended in said other pressure vessel; said fluidized bed cooler having an output end connected to said return flow conduit; said return flow conduit being connected to a space above said dip pot and to a space above said fluidized bed cooler; walls of tubes welded gas-tight together and defining said fluidized bed cooler, said cyclone, said dip pot, said return flow conduit, said connecting conduit, and said fluidized bed burner chamber; a common water-steam circuit operated under continuous flow and connected to said walls of tubes arranged in series; said walls of tubes being connected directly free of intermediate collectors positioned therebetween; said walls of tubes being interlocked so that tubes with downward flow being adjacent tubes with upward flow; ducts connecting said pressure vessels, said connecting conduit being positioned in said ducts; said pressure vessels having pipe systems, said connecting conduit and said return flow conduit forming a connection between said pipe systems; said ducts being horizontal; secondary air nozzles opening into said fluidized bed burner chamber and open to an intermediate space between an inner wall of said one pressure vessel and a pipe wall of said fluidized bed burner chamber; return flow blocking means in said nozzles; said fluidized bed burner chamber, said dip pot, and said fluidized bed cooler having a respective nozzle floor with separate air supply conduits respectively; a gas turbine system with a compressor connected to an intermediate space between respective units and the respective pressure vessel, said intermediate space being subjected to air over pressure from said gas turbine system.

4. A steam generator with pressurized, circulating fluidized bed firing, comprising: a fluidized bed burner chamber; at least one cyclone connected to a flue gas side of said fluidized bed burner chamber through a connecting conduit; said cyclone having a solids output; a fluidized bed cooler connected behind said cyclone; a dip pot connected to said solids output of said cyclone and to said fluidized bed cooler; a return flow conduit connected to said dip pot and entering into said fluidized bed burner chamber; a plurality of pressure vessels, one of said pressure vessels housing said fluidized bed burner chamber; said fluidized bed cooler, said dip pot, and said cyclone being connected to a unit, said unit being housed in another of said pressure vessels; said unit being suspended in said other pressure vessel; said fluidized bed cooler having an output end connected to said return flow conduit; said return flow conduit being connected to a space above said dip pot and to a space above said fluidized bed cooler; walls of tubes welded gas-tight together and defining said fluidized bed cooler, said cyclone, said dip pot, said return flow conduit, said connecting conduit, and said fluidized bed burner chamber; a common water-steam circuit operated under continuous flow and connected to said walls of tubes arranged in series; said walls of tubes being connected directly free of intermediate collectors positioned therebetween; said walls of tubes being interlocked so that tubes with downward flow being adjacent tubes with upward flow; ducts connecting said pressure vessels, said connecting conduit being positioned in said ducts; said pressure vessels being connected through ducts enclosing said connecting duct and said return flow duct; said connecting duct and said return flow duct forming the connection between said walls of tubes arranged within said pressure vessels.

5. A steam generator as defined in claim 4, wherein said pressure vessels have pipe systems, said connecting conduit and said return flow conduit forming a connection between said pipe systems.

6. A steam generator as defined in claim 4, wherein said ducts are horizontal.

7. A steam generator as defined in claim 4, wherein said ducts are inclined.

8. A steam generator as defined in claim 4, including ducts connecting said pressure vessels, said return flow conduit being positioned in said ducts; said pressure vessels having pipe systems, said connecting conduit and said return flow conduit forming a connection between said pipe systems.

9. A steam generator as defined in claim 4, including secondary air nozzles opening into said fluidized bed burner chamber and open to an intermediate space between an inner wall of said one pressure vessel and a pipe wall of said fluidized bed burner chamber; and return flow blocking means in said nozzles.

10. A steam generator as defined in claim 4, wherein said fluidized bed burner chamber, said dip pot and said fluidized bed cooler have a respective nozzle floor with separate air supply conduits respectively.

11. A steam generator as defined in claim 4, including a gas turbine system with a compressor connected to an intermediate space between respective units and the respective pressure vessel, said intermediate space being subjected to air over pressure from said gas turbine system.

* * * * *